US010051704B2

(12) United States Patent
Linnartz et al.

(10) Patent No.: US 10,051,704 B2
(45) Date of Patent: Aug. 14, 2018

(54) LED DIMMER CIRCUIT AND METHOD

(71) Applicant: PHILIPS LIGHTING HOLDING B.V., Eindhoven (NL)

(72) Inventors: Johan-Paul Marie Gerard Linnartz, Eindhoven (NL); Gerardus Op Het Veld, Eindhoven (NL); Ralph Antonius Cornelis Braspenning, Eindhoven (NL); Lars Rene Christian Waumans, Eindhoven (NL)

(73) Assignee: PHILIPS LIGHTING HOLDINGS B.V., Eindhoven (NL)

( * ) Notice: Subject to any disclaimer, the term of this patent is extended or adjusted under 35 U.S.C. 154(b) by 0 days.

(21) Appl. No.: 15/510,693

(22) PCT Filed: Aug. 10, 2015

(86) PCT No.: PCT/EP2015/068360

§ 371 (c)(1),
(2) Date: Mar. 12, 2017

(87) PCT Pub. No.: WO2016/037780

PCT Pub. Date: Mar. 17, 2016

(65) Prior Publication Data

US 2017/0290117 A1 Oct. 5, 2017

(30) Foreign Application Priority Data

Sep. 12, 2014 (EP) ..... 14184583

(51) Int. Cl.
*H05B 33/08* (2006.01)
*H05B 37/02* (2006.01)

(52) U.S. Cl.
CPC ..... *H05B 33/0845* (2013.01); *H05B 33/0815* (2013.01); *H05B 33/0887* (2013.01); *H05B 37/0272* (2013.01)

(58) Field of Classification Search
CPC ..... H05B 33/0815; H05B 33/0833; H05B 33/0845; H05B 33/0887; H05B 37/02; H05B 37/0272; H02M 3/1582; H02M 2001/007; H02M 7/06
See application file for complete search history.

(56) References Cited

U.S. PATENT DOCUMENTS

| | | | | |
|---|---|---|---|---|
| 7,804,256 | B2 * | 9/2010 | Melanson | H05B 33/0815 315/224 |
| 8,040,078 | B1 | 10/2011 | Kpenv | |
| 8,742,686 | B2 * | 6/2014 | Zampini, II | H05B 33/0857 257/13 |
| 8,754,585 | B1 * | 6/2014 | Bahrehmand | H05B 33/0851 315/287 |

(Continued)

FOREIGN PATENT DOCUMENTS

| | | |
|---|---|---|
| EP | 2701461 A1 | 2/2014 |
| EP | 2713678 A1 | 4/2014 |

(Continued)

*Primary Examiner* — Haissa Philogene
(74) *Attorney, Agent, or Firm* — Akarsh P. Belagodu

(57) ABSTRACT

An LED dimmer can be connected between a basic LED driver and an LED arrangement. The dimmer is able at least to receive a constant current from a constant current LED driver, and it then uses a boost converter to provide voltage boosting dependent on a required dimming level.

11 Claims, 5 Drawing Sheets

(56) References Cited

U.S. PATENT DOCUMENTS

| | | | | |
|---|---|---|---|---|
| 9,155,151 | B2 * | 10/2015 | Angeles | H05B 33/0815 |
| 9,173,273 | B2 * | 10/2015 | Zudrell-Koch | H05B 37/02 |
| 9,277,610 | B2 * | 3/2016 | Hsiu | H05B 33/0815 |
| 9,748,858 | B2 * | 8/2017 | Palmer | H02M 3/1582 |
| 2011/0285315 | A1 | 11/2011 | Matthews et al. | |
| 2013/0113386 | A1 | 5/2013 | Suresh | |
| 2013/0300310 | A1 | 11/2013 | Yuequan | |
| 2014/0049730 | A1 | 2/2014 | Bing | |
| 2014/0091724 | A1 | 4/2014 | Palmer | |
| 2014/0016748 | A1 | 6/2014 | Hsiu et al. | |

FOREIGN PATENT DOCUMENTS

| | | | |
|---|---|---|---|
| JP | 01311868 | A | 12/1989 |
| WO | 2013085381 | A2 | 6/2013 |

* cited by examiner

LED DIMMER CIRCUIT AND METHOD

CROSS-REFERENCE TO PRIOR APPLICATIONS

This application is the U.S. National Phase application under 35 U.S.C. § 371 of International Application No. PCT/EP2015/068360, filed on Aug. 10, 2015 which claims the benefit of European Patent Application No. 14184583.4, filed on Sep. 12, 2014. These applications are hereby incorporated by reference herein.

FIELD OF THE INVENTION

The invention relates to approaches for dimming LED lighting arrangements.

BACKGROUND OF THE INVENTION

LEDs are becoming increasingly popular as a lighting solution. LEDs enable flexible lighting options which make use of the dimming capability of LEDs. However, in order to be compatible with existing dimmable systems, complicated and expensive LED drivers are required.

A basic LED driver typically generates either a constant voltage to be applied to the LED or a constant current. The lowest cost LED drivers do not provide a dimming capability.

One common type of LED driver is a so-called window driver. This driver has a fixed output current, but it can deliver this current while adjusting the output voltage over a relatively large range of values, all within its so-called operating window.

Various possible LED driver solutions have been considered by the inventors, to provide dimming (or other intelligent functions) but making use of a basic LED driver.

One solution is to provide dimming functionality on the LED circuit board, by shunt switching some of the current provided by a constant current driver. The shunt switching involves short-circuiting the LED string with a required duty cycle. Indeed, this short circuit function can be implemented as part of a DC-DC converter, for example by short circuiting a buck converter output. One problem with this approach is that there is typically a capacitor in parallel with the driver output, thus in parallel to the DC-DC converter diodes. Hence the driver acts as a current source with a parallel capacitance. Periodically short circuiting this capacitance can lead to unacceptable energy losses and prohibitively large current peaks.

Another solution is to provide dimming functionality on the LED circuit board using a series switch. This involves making the output load open circuit with a required duty cycle. This can in theory be applied to a constant voltage driver. However, in the case of a constant current driver, the driver may not accept this open circuit. Theoretically, an ideal current source would attempt to compensate for an open circuit by raising the output voltage to infinity. A practical driver would reach a limit voltage and then tolerate a lower current flow. However, a driver may see this as a fault condition. In this case, an over-voltage protection system will switch off the complete supply for a certain period of time.

The capacitor across the driver output is again an issue. During periods that the LED string is disconnected by the series switch, this capacitor will charge up to a higher voltage. When the series switch is closed, the extra charge on the capacitor will lead to a high peak current. This results in an increase of the LED current during on periods. Thus, the total power consumed by the LEDs may not change at all, hence not resulting dimming of the LEDs.

There is therefore a need for a low cost dimming solution which avoids the need for an expensive driver such as a DALI driver (DALI being the acronym for Digital Addressable Lighting Interface), and which can for example be connected to a window driver.

SUMMARY OF THE INVENTION

The invention is defined by the claims.

According to an aspect of the invention, there is provided an LED dimmer for connection between an LED driver and an LED arrangement, comprising:

an input for receiving a constant current from the LED driver;

a boost converter providing voltage boosting dependent on a required dimming level; and a first output for providing a signal from the boost converter to a first terminal of the LED arrangement.

This intermediate dimmer is able to receive a constant current input, for example from a constant current window driver, and to implement a dimming control using a boost converter. The boost converter boosts the output voltage, and correspondingly reduces the output current (to maintain the same power), and thereby implements a dimming function.

An inductor may be provided between the input and the anode of a first diode component, with the cathode of the first diode component connected to the first output, and a control switch may be connected between the anode of the first diode component and a current return path to the LED driver. This defines a switched inductor boost converter.

A controller is then provided for controlling the control switch. This controls the boost ratio by varying the switching duty cycle. The control switch for example comprises a transistor. A smoothing capacitor is preferably connected between the output and the current return path, i.e. across the LED arrangement.

The input may further be for receiving a constant voltage from the LED driver. In this way, the dimmer is able to receive and handle a constant voltage input or a constant current input. The dimmer then further comprises a means for determining if the dimmer is receiving a constant voltage or a constant current and a controller for controlling the dimmer by controlling the boost converter in dependence on whether the dimmer is receiving a constant voltage or a constant current. This means for determining may comprise software code that checks what happens to the LED current if the duty cycle is reduced. This can be used to determine whether a constant current or constant voltage is at the input.

The controller may be adapted to operate the boost converter in a first mode when a constant current input is detected, and to operate the boost converter in a second mode when a constant voltage input below the operating voltage of the LED arrangement is detected. These two modes implement a different functional relationship between the desired dimming level and the way the boost converter switch is controlled.

The controller can operate the boost converter in pass-through mode (with the control switch always open) to give a 100% duty cycle. Thus, if no dimming is required, the boost converter is operated so that it does not consume power. This applies to the constant current or constant voltage mode. The boost converter is operated in an active switching mode with a duty cycle 0<d<100% when dimming is required.

When a low voltage input supply is detected, the boost converter circuit is operated as a voltage up converter. The circuit may instead (or additionally) comprise a buck converter, which can be used if a high voltage input supply is detected. It can then be operated to perform a voltage down-conversion.

As explained above, the dimmer may comprise an inductor between the input and the anode of a first diode component, with the cathode of the first diode component connected to the first output, and a control switch connected between the anode of the first diode component and a current return path to the LED driver. The sensor can then be implemented as a sensor resistor connected between the LED arrangement and the current return path. A second switch may be provided in series with the sensor resistor, and a second diode component may be connected between the input and a second output for connection to a second terminal of the LED arrangement.

The second diode component forms part of a buck converter circuit, using the same inductor and storage capacitor as the boost converter. It can be used for down-converting a high voltage supply.

The second switch may be used as part of the sensing function to route the input current or voltage directly through the LED arrangement. This then enables the nature of the input to be determined.

The invention also provides an LED driver arrangement, comprising:

a constant current or constant voltage LED driver; and the dimmer of the invention connected to the output of the LED driver for providing a drive signal to an LED arrangement.

The driver arrangement then incorporates the dimming functionality. The dimmer may be provided on the printed circuit board of the driver, or it may be external to the driver, or it may be provided on the LED arrangement PCB.

A lighting arrangement then comprises:

an LED driver arrangement of the invention; and an LED arrangement.

The dimmer of the LED driver arrangement may be provided on the circuit board of the LED arrangement, so that the overall driver architecture is split into two separate locations.

The invention also provides a driving method for driving an LED arrangement, comprising:

receiving a constant current LED drive signal from an LED driver;

providing voltage boosting dependent on a required dimming level using a boost converter; and providing a signal from the boost converter to a first terminal of the LED arrangement.

The method may comprise:

determining if a received input signal from an LED driver is a constant voltage or a constant current;

if the received input signal is a constant current, performing the method of the invention with the boost converter operated in a first mode;

if the received input signal is a constant voltage below the operating voltage of the LED arrangement, providing voltage boosting dependent on a required dimming level using a boost converter operated in a second mode and providing a signal from the boost converter to a first terminal of the LED arrangement.

The first and second modes may involve controlling the switching of the boost converter in different ways as a function of the required dimming level. For example, the switching duty cycle may be controlled oppositely in dependence on the desired dimming level.

The method may further comprise, if the received input signal is a constant voltage above the operating voltage of the LED arrangement, providing voltage bucking dependent on a required dimming level using a buck converter and providing a signal from the buck converter to a first terminal of the LED arrangement.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides an LED dimmer which can be connected between a basic LED driver and an LED arrangement. The dimmer is able at least to receive a constant current from a constant current LED driver, and it then uses a boost converter to provide voltage boosting dependent on a required dimming level.

The dimmer can be integrated with the LED circuit board, and this provides a dimming solution which involves the use of an LED board that can be connected to a basic window driver. The basic window driver may be a driver that has a fixed output current, but that can deliver this current while adjusting the output voltage over a relatively large range of values.

Figure 1:
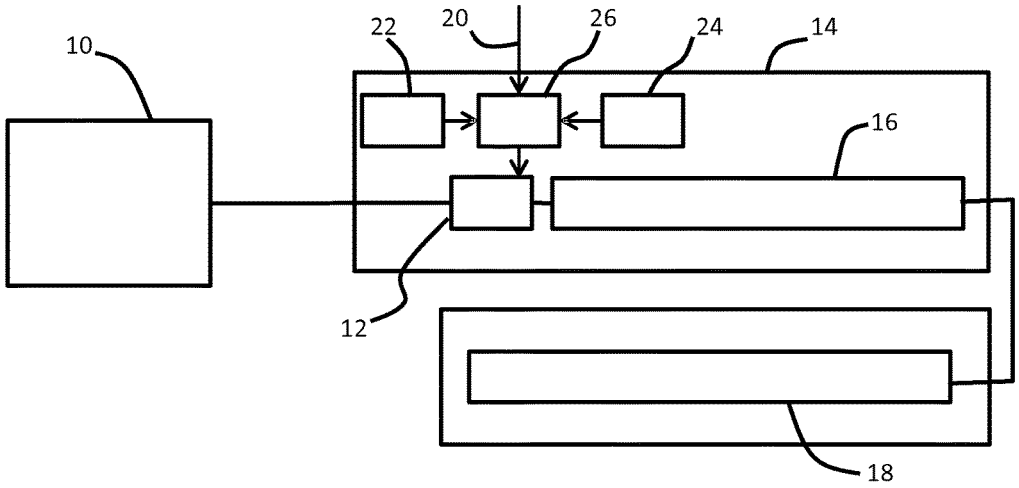
FIG. 1 shows the general configuration of a lighting system in accordance with an example of the invention.

FIG. 1 shows the basic configuration of a lighting arrangement in accordance with an example of the invention.

The arrangement comprises a basic standard LED driver 10, which may for example comprise a constant current window driver. An LED arrangement is coupled to the driver 10 through a dimmer circuit 12 which functions as an intermediate driver. As shown in FIG. 1, the dimmer circuit 12 may be provided on the PCB 14 of the LED arrangement. The LED arrangement comprises a string 16 of LED. There may be multiple strings 16, 18 of LEDs as shown in FIG. 1. If these are all to be dimmed to the same level, then a single dimming unit 12 may be provided as shown. However, multiple dimming units may be provided if independent dimming of different LED strings is desired. The LED PCB 14 typically also includes heat sinks, which are not shown in FIG. 1.

The LED strings may comprise series connections of LEDs, but parallel connections are also possible as well as circuit configurations combining series and parallel connections. The invention may however be applied to a single LED, as well as to a string or multiple strings of LEDs.

The dimmer circuit is an additional on-board intermediate driver and it includes at least a boost function. As will be clear from the examples below, it may include both a buck and boost function.

The basic driver 10 may function as a constant current source but without dimming functionality. This avoids the need for a dimmable window driver, which is the conventional way to implement a dimming function. The architecture of FIG. 1 is more suitable for adding intelligence to the LED board.

FIG. 1 shows the dimmer circuit with an input 20 for receiving an input external to the board 14. This may be an input received from external sensors.

A user interface 22 is also shown, which may for example comprise a touch input, a slider or control knob input, or an audible input. On board sensors 24 are also shown.

These inputs are provided to a controller 26 which controls the dimming circuit 12.

The control of the dimming function may be effected using any one or more of these control inputs 20, 22, 24. When sensors are used, they may comprise daylight sensors or presence sensors, to provide intelligent lighting control.

In more detail, the intelligent LED board comprises:

an LED, LED string or multiple LED strings 16;

a controller 26;

a power supply (not shown) for the controller 26, preferably derived by extracting a small amount of the power provided for the LEDs;

sensors, or interfaces to connect sensors, or interfaces to receive control signals to the board for controlling the dimming function;

a DC-DC boost converter for regulating the light output to provide at least a dimming function.

This arrangement enables local implementation of the dimming function. Preferably, in the undimmed situation, the dimming circuit 12 does not consume a significant amount of power. However, even if the dimmer circuit 12 is set to full dimming (with no current through the LEDs), it should still have the capability to power the circuit functions.

The main convertor 10 is housed in a separate enclosure to the LED arrangement, and offers galvanic isolation. The dimming circuit 12, which includes a DC-DC boost converter, is provided physically on the same board as the LED arrangement.

The DC-DC boost converter makes use of a feedforward pulse width modulation (PWM) function. The duty cycle of the PWM control is varied according to the desired dimming level.

As mentioned above, the controller 26 needs to be powered by the drive signal received from the driver 10. The controller 26 may be powered in parallel with the LED string or a sub-set of the LEDs in the LED string. The subset of LEDs may then have a voltage across them which corresponds to the required voltage supply for the controller. The controller will draw a parallel current which is small compared to the LED current, and will not therefore influence the LED output.

If the controller is powered from the total voltage across the LED string, a DC-DC down convertor can be used to derive the appropriate voltage level.

The controller 26 may alternatively be powered by a circuit in series with the LED string. This series circuit may be a boost convertor.

Alternatively the controller 26 may be powered using an additional winding for the inductor coil used in the DC-DC boost converter of the dimming circuit 12.

Thus, there are various ways to power the circuit controller 26 from the signal received from the basic LED driver 10.

The external control input 20 can also take various forms. There may be an interface for receiving:

a wireless radio link control signal, such as Zigbee, KNX RF;

an optical communications signal, such as Infrared, VLCC or Coded light.

a wireless connection for a digital protocol signal, such as 1 . . . 10, DALI, DMX or I2C.

Figure 2:
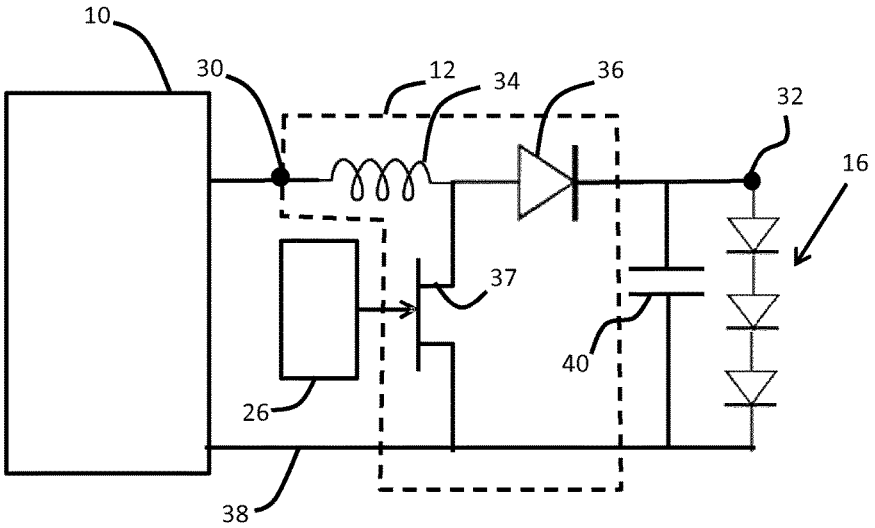
FIG. 2 shows a first example of dimming circuit using a boost converter.

FIG. 2 shows a first example of a possible implementation of the dimming circuit 12.

The basic driver 10 functions as a constant current source.

The dimming circuit 12 is connected between the LED driver 10 and the LED arrangement 16 and comprises an input 30 for receiving the constant current from the LED driver 10 and a DC-DC boost converter providing voltage boosting dependent on a required dimming level, under the control of the controller 26. The boost converter output 32 is provided to a first terminal of the LED arrangement 16.

The boost converter comprises an inductor 34 between the input 30 and the anode of a first (flyback) diode 36, the cathode of the first diode 36 being connected to the first output 32. A transistor 37 functions as a control switch which is connected between the anode of the first diode 36 and a current return path 38 to the LED driver. The transistor is switched by the controller 26. FIG. 2 also shows the smoothing capacitor 40 connected across the LED string 16.

The constant current driver 10 forces a current into the board. The dimming circuit 12 delivers a different current and accordingly varies the output voltage, to conserve power. During dimming, the current through the LED string must be reduced, while the voltage across the LEDs stays fairly constant.

The reduced power demand of the load results in a reduced voltage provided by the driver 10 when delivering the constant current.

An increased voltage at the output is thus required to compensate for the reduction in voltage at which the input current is provided, requiring the use of a boost converter to implement the dimming function.

In a 100% (full power) dimming case, the boost converter can stop switching and feed the current from the basic driver 10 straight into the LED string. Its efficiency is then very close to 100%. The extra converter forming the dimming circuit 12 does not lead to extra losses.

During dimming below 100% the boost converter starts switching, and some performance penalty can occur, typically around 3% but the savings due to lowering the light power are significant and can be up to 90%.

The arrangement of FIG. 2 is very simple in terms of the number of components. It provides a novel combination of a fixed current primary driver followed by a boost converter.

When deep dimming is required, the voltage input reduces significantly to track the reduction in power demand by the LED arrangement. The driver may not have a sufficiently large voltage operating window and may switch off at a certain dimming level, because its short-circuit protection will kick in. Thus, the maximum dimming level may be selected based on the characteristics of the driver 10. As explained below, these characteristics can be obtained by a test procedure.

Most preferably the driver 10 is configured to continue to deliver its current even at low voltage. The threshold for effecting short circuit protection is preferably low, for example around 10 Volts or even lower for LED strings of 10 to 20 LEDs that normally require about 30 to 60 Volts to operate. For longer strings of LED, for instance if medium or low power LEDs are used, a higher short circuit protection threshold can be worked with. The lower boundary of the dimming range is however dictated by the ratio between the nominal voltage and the driver output voltage at which the short circuit protection is effected.

An optional extension of the idea is that the dimmer can detect if a short-circuit protection mechanism has kicked in when it has attempted to operate below a certain voltage or outside a certain range of duty cycles. The dimmer can detect this by measuring that the output (voltage or current) of the driver drops to zero. If this behaviour is observed, the dimmer can then in future avoid such duty cycle settings or only tolerate a limited degree of dimming.

The power for the controller 26 may still be taken from the first one or two LEDs. Particularly, if deep dimming for example below 10% is not needed, the current through the LEDs is always higher than 10% of the maximum current. As long as the controller does not consume more than a few milliamps this can be acceptable without visually affecting the brightness of the LEDs used to generate the controller power supply.

The example of FIG. 2 makes use of a boost converter.

Figure 3:
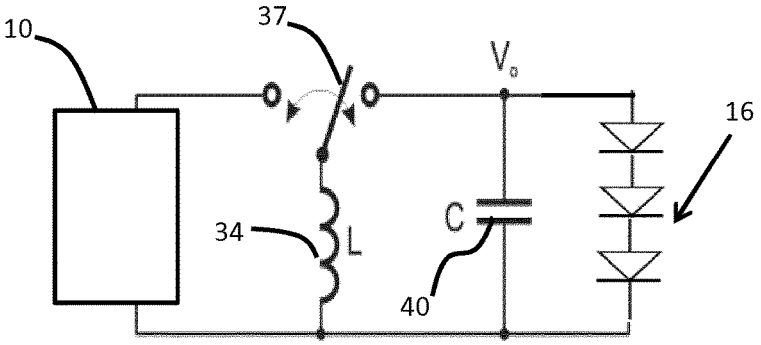
FIG. 3 shows a buck-boost converter which can be used instead of a boost converter.

A buck boost converter may instead be used. FIG. 3 shows a buck-boost converter. The same components are given the same reference numbers. In this case, the output of the constant current driver 10 is coupled to the output through a series switch 37. In one switch position, the inductor 34 is coupled to the driver 10 and in the other position it is connected to the LEDs 16 with the parallel output capacitor 40. The buck-boost converter does not have a pass-through mode, because there is no switch position in which the driver 10 directly feeds the LEDs 16. There must always be active switching to produce light from the LEDs, which typically introduces extra losses even when just the nominal (undimmed, maximum) light-output is required.

Thus, the advantage of a boost converter is that 100% efficiency is achieved in the non-switching (non-dimming) mode.

The example above is designed specifically for a constant current basic driver 10.

Figure 4:
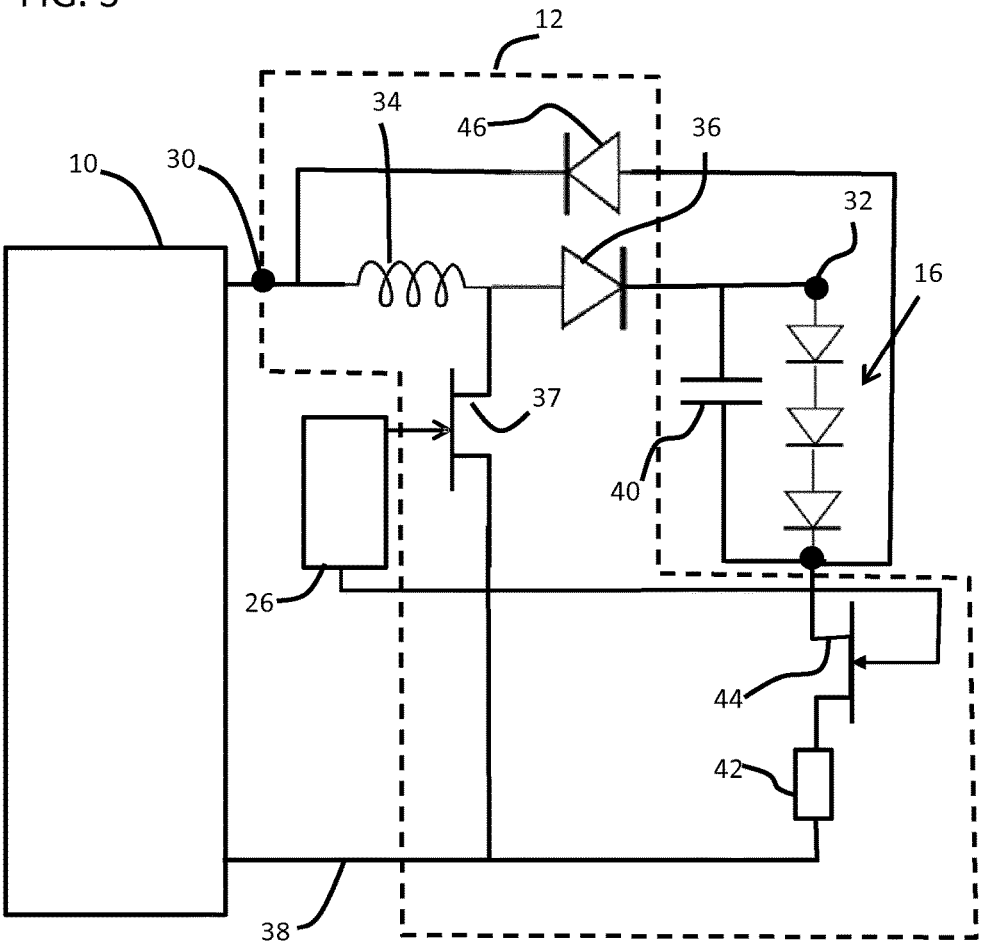
FIG. 4 shows a second example of dimming circuit.

FIG. 4 shows a modification to the dimming circuit which enables up conversion or down conversion and which can be connected to a driver which functions either as a current source or as a voltage source.

The same components as in FIG. 2 are given the same reference numbers. The input 30 is thus also able to receive a constant voltage from the LED driver. The circuit has a sensor which comprises a sensor resistor 42 connected between the LED arrangement 16 and the current return path 38. A second switch 44 is in series with the sensor resistor 42, and a second diode 46 is connected between the input and a second output for connection to a second terminal of the LED arrangement.

The sensor resistor 42 is used for measuring the current through the LEDs. This can further be used for determining if the dimmer is receiving a constant voltage or a constant current. In fact the current through the LED changes (increases or decreases) in the opposite direction for a constant current driver compared to a constant voltage driver. The dimmer software can learn this behaviour during an initial set up phase. Thus, the sensor resistor may not be required.

The controller 26 can then control the dimmer circuit (in particular the first and second transistors) in dependence on the sensed type of input to the dimmer, and also know whether it should increase or decrease the duty cycle in order to reduce the LED current (to implement dimming).

The inductor 34, capacitor 40, switch 44 and diode 46 are configured as a buck converter. The circuit can then operate as a voltage down converter for a high input supply voltage.

When the circuit is used with a constant current driver, transistor 44 is always on, and transistor 37 is switched. The circuit then functions in the same way as the circuit of FIG. 2, and the light output is proportional to 1−d, where d is the switching duty cycle of the DC-DC boost converter. Thus d=0 is for no switching and full light output, and d=0.9 is for deep dimming to a 10% brightness level.

When the circuit is used with a low-voltage constant-voltage driver, such as a halogen 12 Volt AC transformer, a rectifier is added between transformer 10 and dimmer input 30. The transistor 44 is always on, and transistor 37 is again switched. The light output is proportional to the duty cycle, and the boost circuit functions as a voltage up converter.

When the circuit is used with a high voltage constant voltage driver, transistor 37 is always open, and transistor 44 is used for buck down-conversion, making use of diode 46. The diode 36 is always forward biased and plays no role, so that the circuit functions only as a buck converter.

Thus, there are three possible modes of operation, two making use of up conversion using the boost converter and one making use of down conversion using the buck converter.

When used with a current source driver:

LED current=(1−d) times the input current.

Input voltage generated by the constant current driver=(1−d) times required LED string voltage. This is the voltage that needs to be boosted back to the desired LED string voltage.

In this arrangement, there are no safety related limits to Ton and L, that is there are no choices for Ton and L that will severely damage the driver.

For a non-dimmed output, the boost converter is run in pass-through mode (switch 37 always open), so that current always flows always from the primary driver 10.

To achieve dimming, the duty cycle is altered. The full range of duty cycles can be used.

When used for voltage boosting of a low voltage source driver (providing a constant voltage below the operating voltage of the LED arrangement), the circuit operates in active switching mode.

The energy per cycle=$\frac{1}{2}Li^2$ where di/dt=V/L, thus i=Vt/L.

At the moment of switching off, $E=\frac{1}{2}V^2T_{on}^2/L$. This energy is released during $T_{cycle}$.

The power is $E/T_{cycle}=\frac{1}{2}V^2T_{on}^2/(LT_{cycle})$.

For a fixed on time $T_{on}$, the dimming level is proportional to d (i.e. proportional to $T_{on}$).

Thus, it can be seen that the light output reacts in an opposite way to the change in duty cycle, compared to the constant current driver. The light output is proportional to (1−d) for the constant current driver and it is proportional to d for the low voltage constant voltage driver. This is mentioned above.

When used for voltage down converting of a high voltage source driver (providing a constant voltage above the desired the operating voltage of the LED arrangement), the circuit operates using the buck converter that runs in an active switching mode.

The circuit of FIG. 4 can thus operate with a current source and with a voltage source either above or below the desired LED voltage. The circuit is the same, but the software control algorithm is different. The circuit can automatically adjust its operation to the type of driver which is connected to the circuit.

In particular, at initial power up, the LED board does not know the characteristics of the driver, for example it does not know whether a voltage source or a current source is connected. One registration procedure will be described making use of the current sense resistor.

A first registration step involves opening transistor 37 and closing transistor 44. This disables the boost converter circuit (and the buck converter circuit) and routes the supplied power to the LED arrangement. The voltage VR across the sense resistor 42 is monitored, which correlates with the current through the resistor 42, and the output voltage VO (on terminal 30) is also monitored.

If VR increases above a maximum threshold, and VO remains constant then the connected driver is a high voltage driver. In this case, the circuit should be operated in a buck mode.

If VR settles at a value near the maximum operating range of the LEDs, then the connected driver is a current driver. The dimming function can then be tested by switching transistor 37 starting with a low duty cycle. The voltage VR should then lower according to (1−d) since the LED current is reduced. Voltage VO should also lower as the constant current driver operates at a lower voltage within its operating window. The lowest value of the duty cycle at which VO remains stable can then be determined so that the deepest dimming level suitable for the particular driver can be determined.

If VR remains close to zero, then the connected driver is a low voltage driver e.g., a 12 Volt halogen driver. The circuit can then be tested by attempting to increase the light level by switching transistor 44 starting with a low duty cycle. The average voltage VR should then increase according to d. The voltage VO should stay constant.

The dimming capability may be incorporated into the circuit board which carries the LED, or it may be provided on the driver circuit board, or it may be a separate unit.

Figure 5:
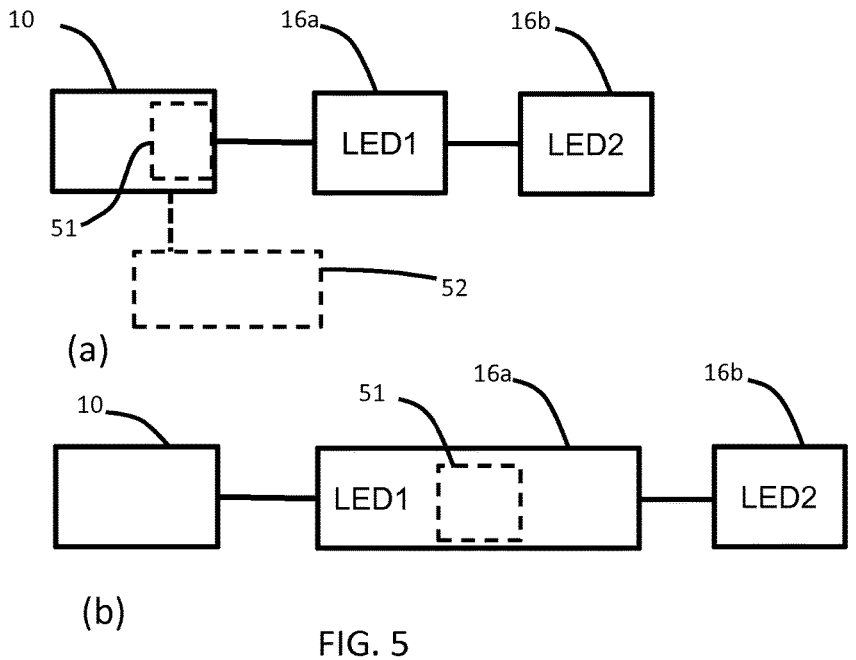
FIG. 5 shows two possible ways to implement the dimming circuit onto an existing printed circuit board.

FIG. 5(*a*) shows a dimmable driver 10, which comprises the combination of a standard constant current or constant voltage driver (without dimming capability) and the switch mode circuit 51 as explained above for implementing the dimming function. The dimmable driver 10 drives two LED arrangements 16*a*, 16*b*. The dimming function can be controlled remotely, and for this purpose unit 52 may comprise an RF receiver. The dimming function may also or instead be controlled automatically based on a light sensor input, so that unit 52 may in that case comprise a sensor.

FIG. 5(*b*) shows a standard constant current or constant voltage driver 10 (without dimming capability). The switch mode circuit 51 as explained above for implementing the dimming function is provided on the circuit board of a first LED arrangement 16*a*. A second LED arrangement 16*b* is daisy-chained from the first.

Figure 6:
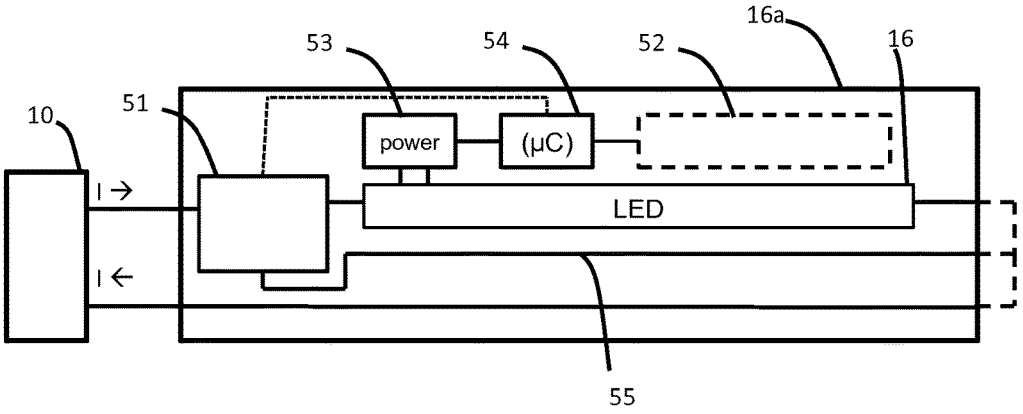
FIG. 6 shows in more detail the architecture of an LED printed circuit board incorporating the dimming circuit.

FIG. 6 shows in more detail the components carried by the first LED circuit board 16*a* in FIG. 5(*b*). The dimming control circuit is shown as 51. The dimming circuit 51 receives a constant current. The effect of the switch mode circuit 51 is to allow part of the current to bypass the LED string 16 along bypass path 55. The currents sum again at the output of the LED string 16 for return to the driver 10. A power supply 53 provides power to a processor 54 which implements the boost converter switch controller and which can also implement the intelligent detection of whether the driver 10 is a current source driver or a voltage source driver, as explained above. An RF interface and/or light sensor is also shown as 52.

Figure 7:
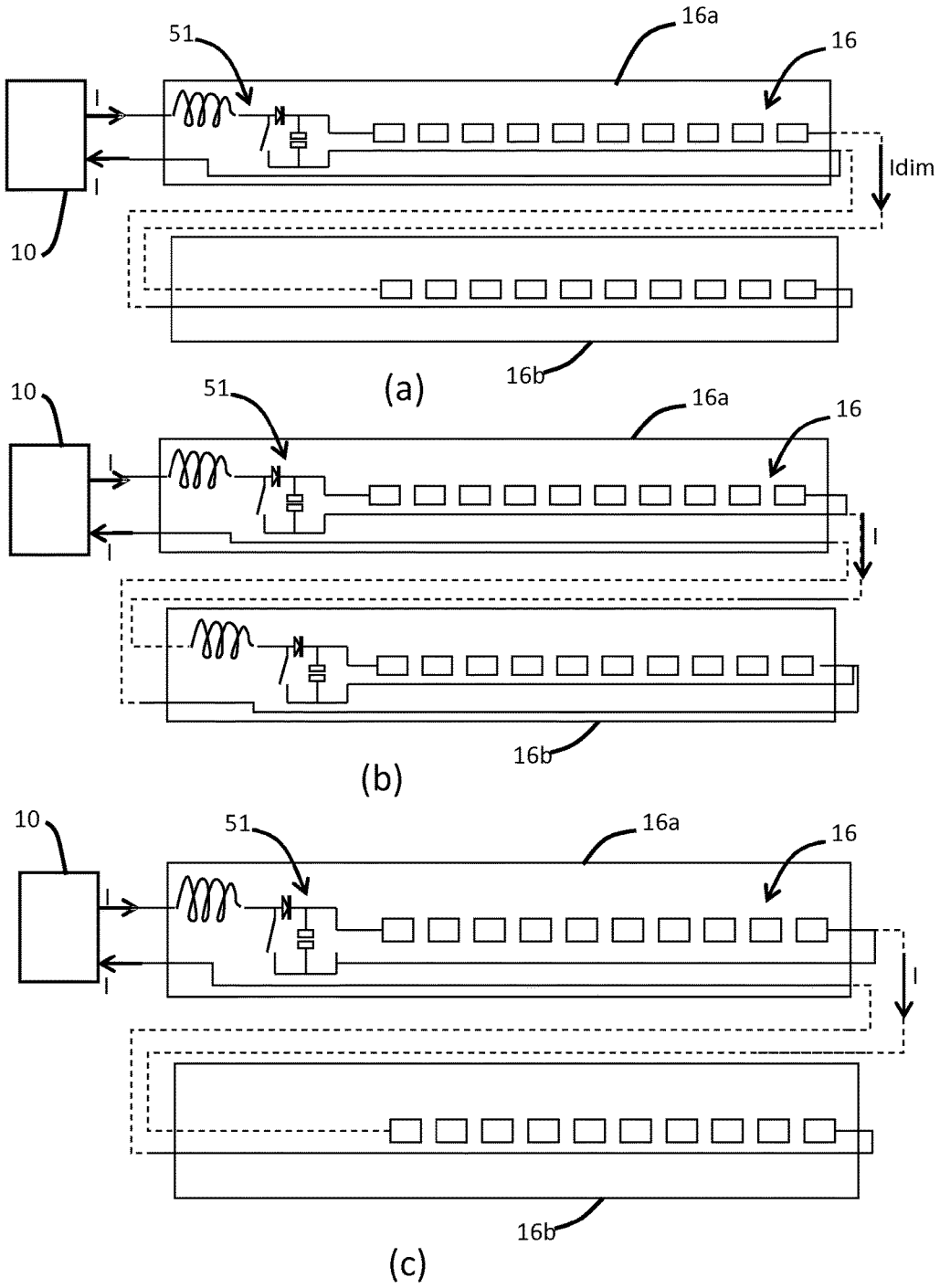
FIG. 7 shows three possible ways to combine multiple LED arrangements.

Multiple LED arrangements can be combined in various ways, and FIG. 7 shows three examples. In FIG. 7(*a*) the two LED arrangements 16*a*, 16*b* are simply in series. The dimmed current Idim generated by the first LED arrangement 16*a* is provided to the second LED arrangement 16*b*. Only the first LED arrangement 16*a* has the dimming capability.

For a constant current driver and using a voltage boost converter;

output voltage=input voltage/(1−d)

where d is the duty cycle. Thus:

output current−input current*(1−d).

No matter how many LED arrangements are used, the desired current level can be set based on the duty cycle control. For a number N of LED arrangements, the driver does however need a voltage window which covers the range from Min*N*Vs to N*Vs where Vs is the LED string voltage for each LED arrangement, and Min is the minimum dimming level.

FIG. 7(*a*) is essentially a master LED board 16*a* followed by a slave LED board 16*b*.

FIG. 7(*b*) shows two master LED boards 16*a*, 16*b* in series. The LED current and the bypass current from the first LED board are combined (to form original current I) before supply to the second LED board 16*b*. Each one can control its associated LED string in the same way or independently.

Two master LED circuit boards can instead be in parallel.

FIG. 7(*c*) shows an arrangement in which the master board 16*a* has dimming control and the slave board 16*b* is in series but is driven to full brightness, and it receives the full recombined current I. In this case, the driver must have a voltage window that covers the range (Min+1)Vs to 2Vs (for the example of two LED boards).

Figure 8:
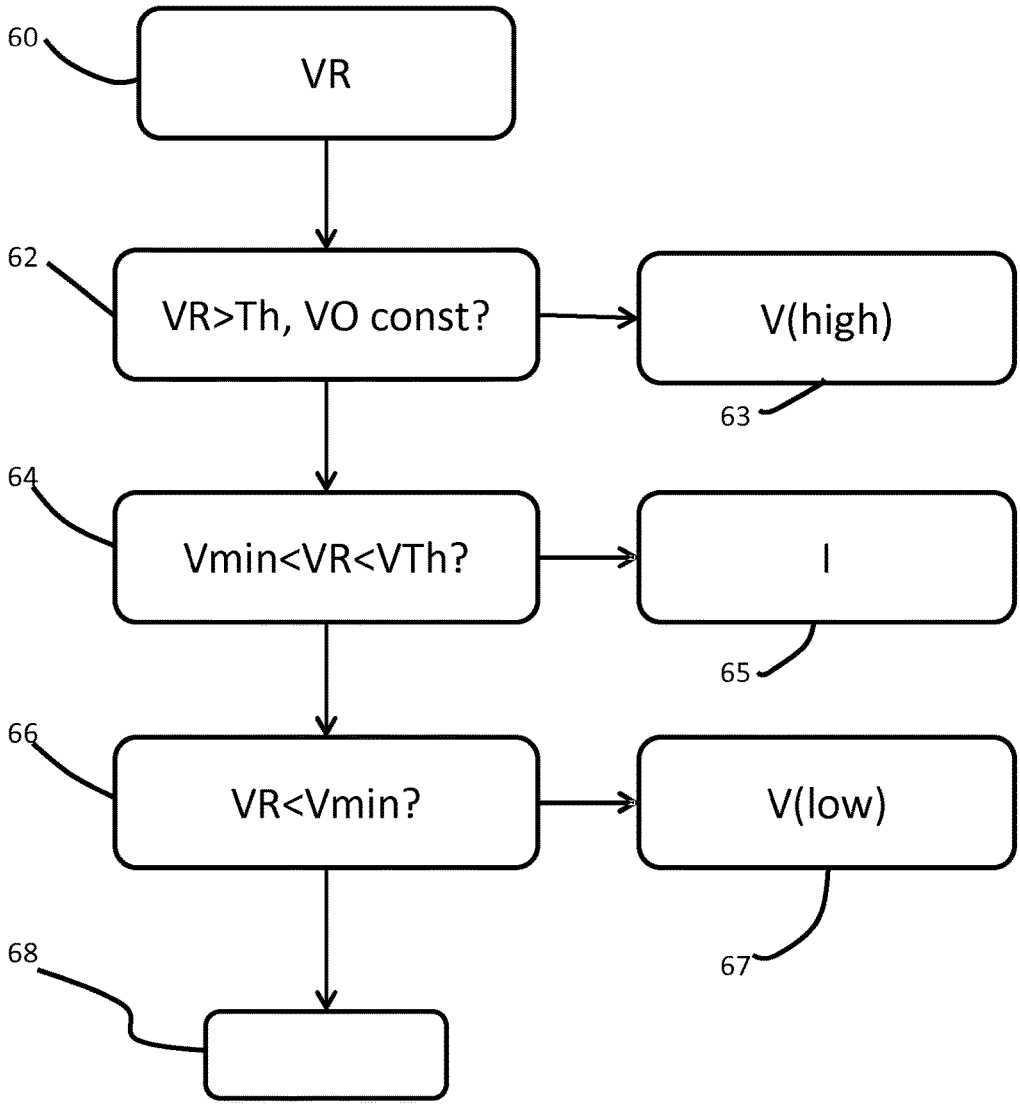
FIG. 8 shows an example of drive method.

FIG. 8 shows the method of determining the type of driver.

In step 60 the resistor voltage VR is measured.

In step 62 it is determined if the voltage VR is above a maximum threshold (and optionally also that the output voltage is constant). If so, it is determined in step 53 that a high voltage driver is connected.

In step 64 it is determined if the voltage VR is above a minimum value but below the threshold. This range includes the normal maximum operating voltage of the LEDs. If so, it is determined in step 65 that a constant current driver is connected, since the voltage corresponds to the normal driving of the LEDs.

In step 66 it is determined if the voltage is below the minimum. If so, it is determined in step 67 that a low voltage driver is connected.

The process ends in step 68.

Some examples in accordance with the invention enable an entry level low cost driver to be made suitable for luminaires in which dimming is performed. The combination of the dimming circuit and the LED arrangement is backwards compatible, so that can it work in all products in which the existing LEDs are used. The use of on-board sensors enables a daylight harvesting function to be implemented. The LED arrangement and dimming circuit can autonomously dim its light output level while still working with the existing fixed current drivers.

Other examples provide an LED board which can automatically recognize whether it is driven by a voltage source or a current source and can then adapt its internal dimming algorithm accordingly.

The LED driver circuits shown make use of diodes. However, it will be understood by those skilled in the art that the rectifying function can also be implemented using other components. For example, a transistor can be configured as a rectifier, or a transistor can be actively switched to conduct at instants when the current is expected to flow in a particular direction (e.g. in synchronous rectifiers, half bridges etc.). The term "diode component" as used in the claims is intended to encompass all of these possibilities.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. An LED dimmer for connection between an LED driver and an LED arrangement, comprising:

an input for receiving a constant current and a constant voltage from the LED driver, wherein an inductor is displaced between the input and an anode of a first diode component;

a means for determining if the LED dimmer is receiving a constant voltage or a constant current, the means comprising a sensor resistor connected in series with the LED arrangement;

a converter circuit providing voltage conversion dependent on a required dimming level, wherein the converter circuit comprises at least one of a boost converter and a buck converter;

a controller for controlling the LED dimmer by controlling the converter circuit in dependence on whether the LED dimmer is receiving a constant voltage or a constant current;

a first output for providing a signal from the converter circuit to a first terminal of the LED arrangement, wherein a cathode of the first diode component is connected to the first output;

a control switch connected between the anode of the first diode component and a current return path to the LED driver;

a second switch in series with the sensor resistor; and a second diode component connected between the input and a second output for connection to a second terminal of the LED arrangement.

2. An LED dimmer as claimed in claim 1, wherein the controller is adapted to operate the converter circuit in a first mode when a constant current input is detected, and to operate the converter circuit in a second mode when a constant voltage input below the operating voltage of the LED arrangement is detected.

3. An LED dimmer as claimed in claim 1, wherein the controller is controlling the control switch.

4. An LED dimmer as claimed in claim 3, wherein the control switch comprises a transistor.

5. An LED dimmer as claimed in claim 1, further comprising a capacitor connected between the first output and the current return path.

6. An LED driver arrangement, comprising:

a constant current or constant voltage LED driver; and an LED dimmer as claimed in claim 1 connected to the output of the LED driver for providing a drive signal to the LED arrangement.

7. A lighting arrangement, comprising:

the LED driver arrangement as claimed in claim 6; and the LED arrangement.

8. A lighting arrangement as claimed in claim 7, wherein the LED dimmer is provided on a circuit board of the LED arrangement.

9. A driving method for driving an LED arrangement, comprising:

receiving an input signal at an input from an LED driver on an input of a LED dimmer, wherein an inductor is displaced between the input and an anode of a first diode component;

determining, using at least a sensor resistor connected in series with the LED arrangement, if the received input signal is a constant voltage or a constant current;

providing voltage conversion dependent on a required dimming level using a converter circuit, wherein the converter circuit comprises at least one of a boost converter and a buck converter;

controlling the LED dimmer by controlling the converter circuit in dependence on whether the LED dimmer is receiving a constant voltage or a constant current; and providing a signal from the converter circuit to a first terminal of the LED arrangement, wherein a cathode of the first diode component is connected to the first output, and wherein a control switch is connected between the anode of the first diode component and a current return path to the LED driver, a second switch is in series with the sensor resistor, and a second diode component is connected between the input and a second output for connection to a second terminal of the LED arrangement.

10. The driving method of claim 9, wherein the converter circuit comprises a boost converter, the method comprising:

if the received input signal is a constant current, providing the boost converter operated in a first mode;

if the received input signal is a constant voltage below the operating voltage of the LED arrangement, providing voltage boosting dependent on the required dimming level using a boost converter operated in a second mode and providing a signal from the boost converter to a first terminal of the LED arrangement.

11. A method as claimed in claim 10, wherein the converter circuit further comprises a buck converter, the method further comprising, if the received input signal is a constant voltage above the operating voltage of the LED arrangement, providing voltage bucking dependent on the required dimming level using the buck converter and providing a signal from the buck converter to a first terminal of the LED arrangement.

* * * * *